US007014081B2

(12) United States Patent
Ortin et al.

(10) Patent No.: US 7,014,081 B2
(45) Date of Patent: Mar. 21, 2006

(54) DEVICE FOR DRAWING OFF AND CUTTING A TAPE FROM A SUPPLY ROLL

(75) Inventors: Philip Ortin, Hamburg (DE); Giorgio Orlandini, Sirolo (IT)

(73) Assignee: tesa AG, Hamburg (DE)

( * ) Notice: Subject to any disclaimer, the term of this patent is extended or adjusted under 35 U.S.C. 154(b) by 287 days.

(21) Appl. No.: 10/258,082

(22) PCT Filed: Apr. 6, 2001

(86) PCT No.: PCT/EP01/03994

§ 371 (c)(1),
(2), (4) Date: Oct. 4, 2002

(87) PCT Pub. No.: WO01/76997

PCT Pub. Date: Oct. 18, 2001

(65) Prior Publication Data

US 2003/0141338 A1 Jul. 31, 2003

(30) Foreign Application Priority Data

Apr. 7, 2000 (IT) ..... MI2000A0744

(51) Int. Cl.
*B26F 3/20* (2006.01)

(52) U.S. Cl. ..... 225/65; 225/66; 225/89

(58) Field of Classification Search ..... 225/65, 225/66, 67, 85, 89, 56
See application file for complete search history.

(56) References Cited

U.S. PATENT DOCUMENTS 1,016,893 A * 2/1912 Oppenheimer et al. ..... 225/13
3,109,570 A * 11/1963 Maddalena ..... 225/66
5,921,450 A * 7/1999 Robinson ..... 225/56
6,152,398 A * 11/2000 Chen ..... 242/588

* cited by examiner

*Primary Examiner*—Kenneth E. Peterson
*Assistant Examiner*—Isaac N. Hamilton
(74) *Attorney, Agent, or Firm*—Norris McLaughlin & Marcus, PA; Christa Hildebrand

(57) ABSTRACT

A device for drawing off and cutting a tape from a supply roll, a tubular core piece of the roll rotatably accommodating a bearing and guiding bracket which is formed from an elastically deformable curved piece and, at its free end, the curved bracket accommodating pins which are arranged transversely and pivotably mount two arms which are arranged parallel to each other and extend along the side surfaces of the roll, the free ends of the arms arranged parallel to each other being connected to each other via a transverse rib, and a cutting blade projecting from the plane of the transverse rib and, furthermore, holding wings which are aligned in the unwind direction of the tape and on which the free end of the tape rests being arranged at the front side of the parallel arms.

6 Claims, 4 Drawing Sheets

DEVICE FOR DRAWING OFF AND CUTTING A TAPE FROM A SUPPLY ROLL

BACKGROUND OF THE INVENTION

1. Field of the Invention

The present invention relates to a device for drawing off and cutting a tape from a supply roll. From the prior art, it is known that adhesive tapes are normally wound up onto a tubular core, in order thereby to create a tape roll which accommodates a predetermined amount of an adhesive tape.

2. Description of the Related Art

Tapes which are offered in the form of a roll can be drawn off from the tape roll, for example, without the aid of a special unrolling or cutting device.

This procedure prevents quick and clean handling during an operation of drawing off the tape.

From the prior art, holding devices have also been disclosed which mount a tape roll and provide the possibility of drawing off the tape and also severing it quickly and cleanly.

These devices, particularly when they are used to draw off and cut relatively wide tapes, are heavy, assume large dimensions and frequently have a considerable technical structure.

Devices for drawing off and cutting tapes have also been disclosed which are formed as stationary devices and which are used to handle tape rolls of relatively large diameter.

Furthermore, smaller cutting devices have also been disclosed by the prior art, and are produced from plastic, for example.

These devices have the disadvantage that they do not hold the adhesive tape roll securely and practically. For example, in the case of these known devices, it is particularly important, when drawing off or cutting the tape, to carry out these operations very carefully.

Furthermore, precautions have to be taken, on the basis of which the free end of the adhesive tape, which projects from the circumference of the roll, is prevented from coming to rest on the circumference of the roll and sticking to the circumference of the roll.

SUMMARY OF THE INVENTION

It is an object of the present invention to avoid the disadvantages of the prior art and to permit a device for pulling off and cutting a portion of an adhesive tape, the intention being for the drawing-off and cutting operation to be carried out quickly and cleanly, irrespective of the diameter of the tape roll, and furthermore the possibility being provided to define the local position of the cutting blade reliably with respect to the changing circumference of the roll.

Furthermore, the intention is to ensure that the end of the tape projecting from the roll following the severing of a desired tape portion does not come to rest on the circumference of the roll, in order to stick fast there.

According to the invention, this object is achieved by a device for drawing off and cutting an adhesive tape from a supply roll in that a tubular core piece of the roll rotatably accommodates a bearing and guiding bracket which is formed from an elastically deformable curved piece and, at its free end, the curved bracket accommodates pins which are arranged transversely and pivotably mount two arms which are arranged parallel to each other and extend along the side surfaces of the roll, the free ends of the arms arranged parallel to each other being connected to each other via a transverse rib, and a cutting blade projects from the plane of the transverse rib, and holding wings which are aligned in the draw-off direction of the tape and on which the free end of the tape rests are arranged at the front side of the parallel arms.

With a drawing-off device which has these features, a device is provided which is of simple design from the technical standpoint and, moreover, with the new device it is possible to adapt automatically and continuously to the changing diameter of the tape roll.

The device for drawing off and cutting the tape from a roll is advantageously equipped with a holding bracket which has lateral ribs which enclose the side surfaces of the tubular core and thus form guiding devices.

Coinciding with the transverse pin, each arm widens in a disk shape and has toothing along a portion of its circumference, said toothing coming into an operative connection in a barbed manner with teeth which are provided at the end of the holding bracket.

This opens up the possibility of blocking the parallel arms in one direction, opposite to the clockwise direction, but at the same time of permitting a movement in the clockwise direction, in order to enable continuous adaptation to the reducing diameter of the tape roll.

The device has a simple structure and can accommodate any desired tape roll.

The components particularly advantageously rest on the changing circumference of the tape roll, which provides the possibility of drawing off and severing a required portion of the adhesive tape quickly and securely.

Furthermore, the situation is advantageously avoided in which the free and projecting adhesive tape can spring back in the direction of the roll circumference; this avoids the tape coming into contact with the circumference of the tape roll in an undesired manner and resting on there.

BRIEF DESCRIPTION OF THE DRAWINGS

The device according to the invention will now be described in more detail and illustrated in the appended drawings.

DETAILED DESCRIPTION OF THE PRESENTLY PREFERRED EMBODIMENTS

Figure 1:
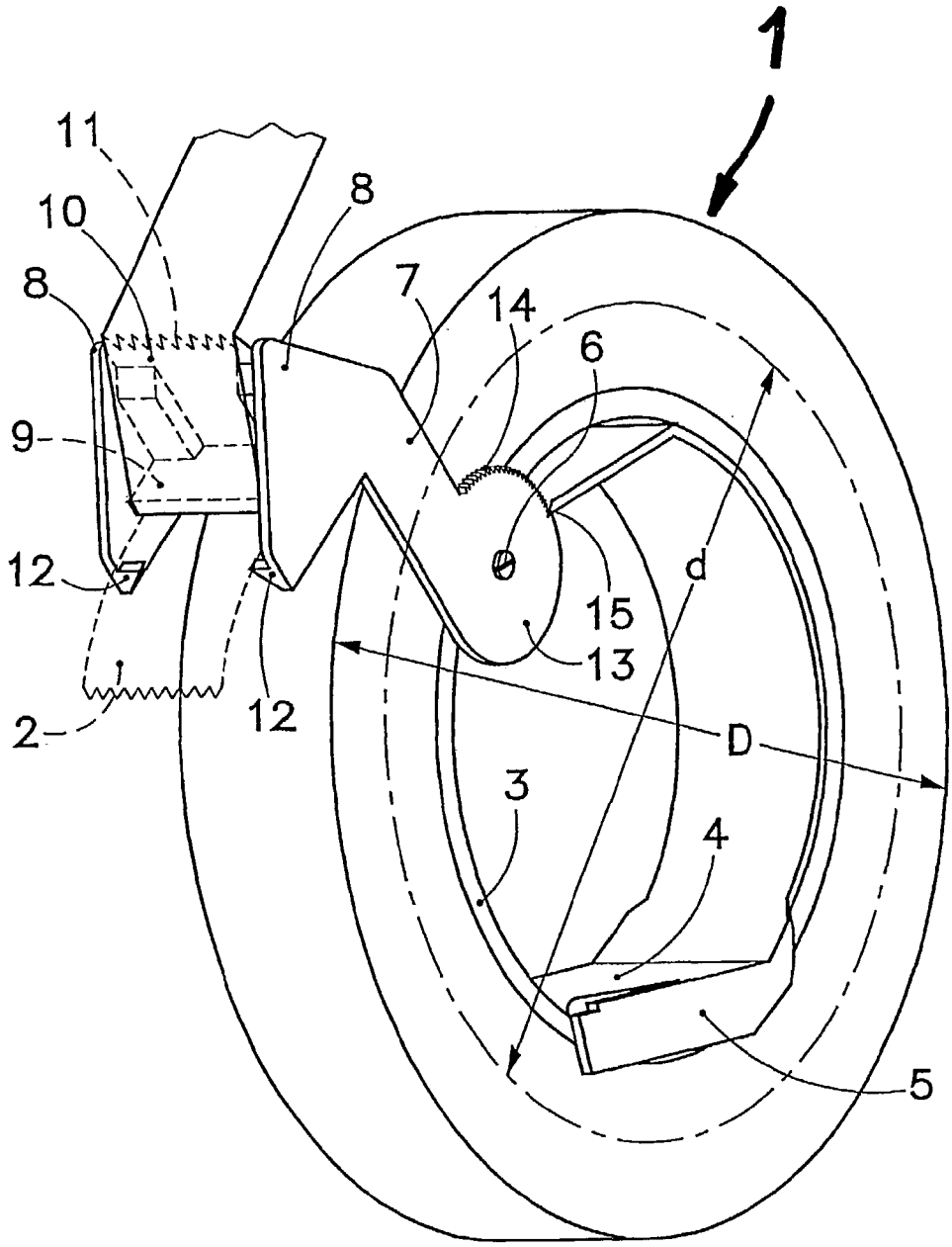
FIG. 1 shows a perspective view of the roll of an adhesive tape together with the device according to the invention.

As can be gathered from FIG. 1, the tape roll identified overall by 1 comprises a wound-up adhesive tape 2 which is wound up on a tubular core 3.

The roll 1 originally has a diameter (D).

As the tape is drawn off, the diameter (d) decreases until the tape 2 is used up.

The tubular core 3 accommodates a bearing bracket 4, which is of curved design and advantageously consists of plastic and is elastically deformable.

The bearing bracket 4 has ribs 5 which project laterally and which engage around the tubular core 3 and the tape roll 1 at the sides.

The ribs 5 are used as guide elements during the rotational movement of the tape roll 1. This rotational movement takes place during the action of drawing off the adhesive tape 2.

At the free end of the holding bracket 4, which is opposite the section with the lateral guide ribs, the holding bracket 4 accommodates on both sides a transverse pin 6, and the latter mounts pivotable arms 7 which are arranged parallel to the sides of the tape roll 1.

The free ends 8 of the parallel arms 7 are connected to each other via a plate or transverse ribs 9.

At right angles to the plate 9, a blade 10 projects from the latter, and is provided with a cutter 11.

On the underside—as viewed in the draw-off direction of the tape 2—the ends 8 of the arms 7 have small wings 12 which project under the plate 9 and which are oriented toward each other. The front piece of the tape 2 which projects from the circumference of the tape roll 1 rests on the wings 12.

Coinciding with the transverse pins 6, each arm 7 widens and changes into a disk-like element 13.

The disk-like element 13 has toothing 14 along a portion of its circumference, with which toothing a corresponding holding tooth 15 comes into an operative connection, the holding tooth 15 is provided at each free end of the elastically deformable bracket 4.

Figure 2:
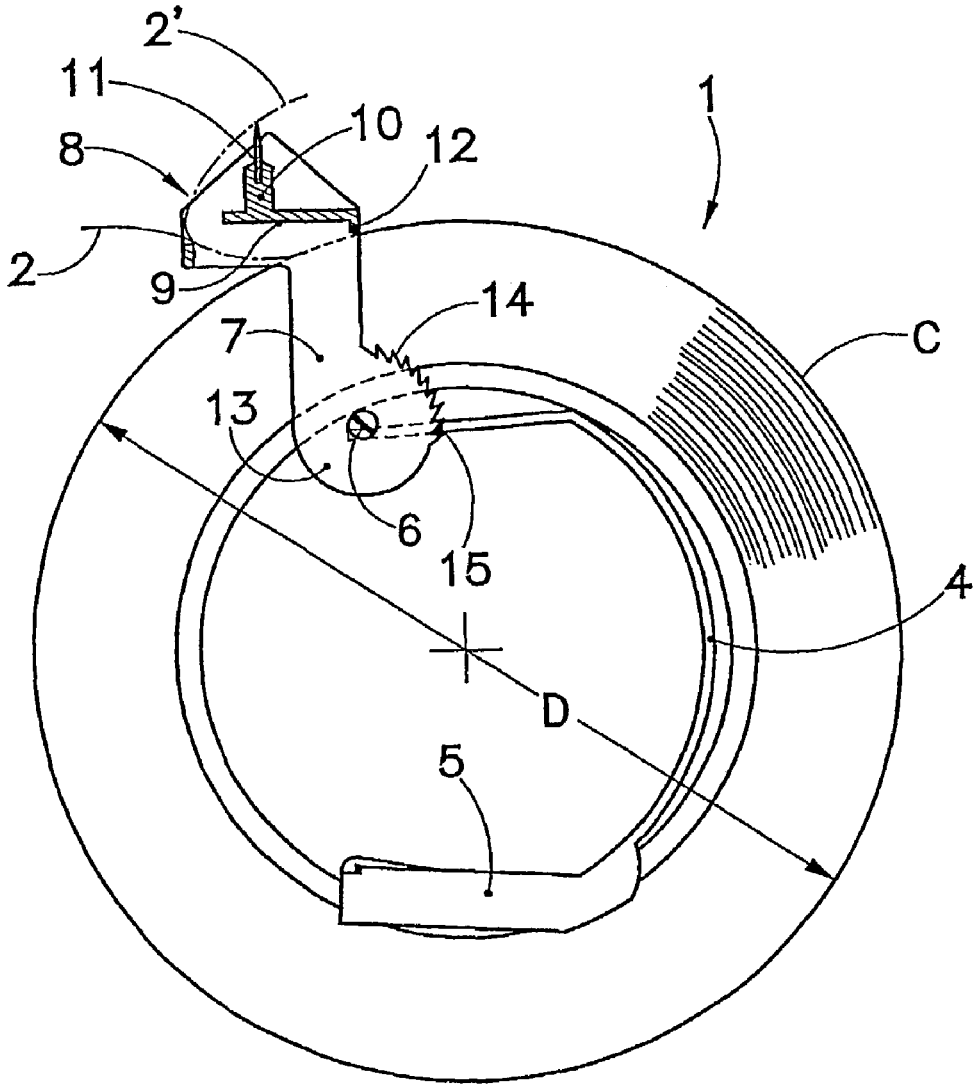
FIG. 2 shows an elevation of a tape roll of relatively large diameter (D) together with a drawing-off and cutting device, which is illustrated partly in section.

In FIG. 2, the tape roll 1, consisting of a wound-up tape 2, can be seen in side view. The upper portion 8 of the arm 7 is illustrated in section. According to FIG. 2, the roll 1 has a relatively large diameter (D).

FIG. 2 further reveals that, at the free end 8, the arms 7 are connected to each other via a rib 9. The rib 9 crosses over the circumference C of the roll 1 in the manner of a bridge.

From the rib 9 there projects a blade 10 which, on its upper side, has a cutter 11 which is used to sever a portion 2' of the tape with a desired length.

It can be seen from FIG. 2 that the teeth 15, designed in the manner of barbs, which are provided on both sides of the elastically deformable bracket 4, cooperate with the toothing 14 of the arms 7.

On the front side and under the transverse rib 9, each arm 7 has wing-like projections 12, which are opposite each other and serve to form supports or guide means for the tape 2.

The teeth 15 can come into connection with the corresponding toothing 14, which provides a locking device for the arms 7 which permits pivoting with respect to the pins 6.

Figure 3:
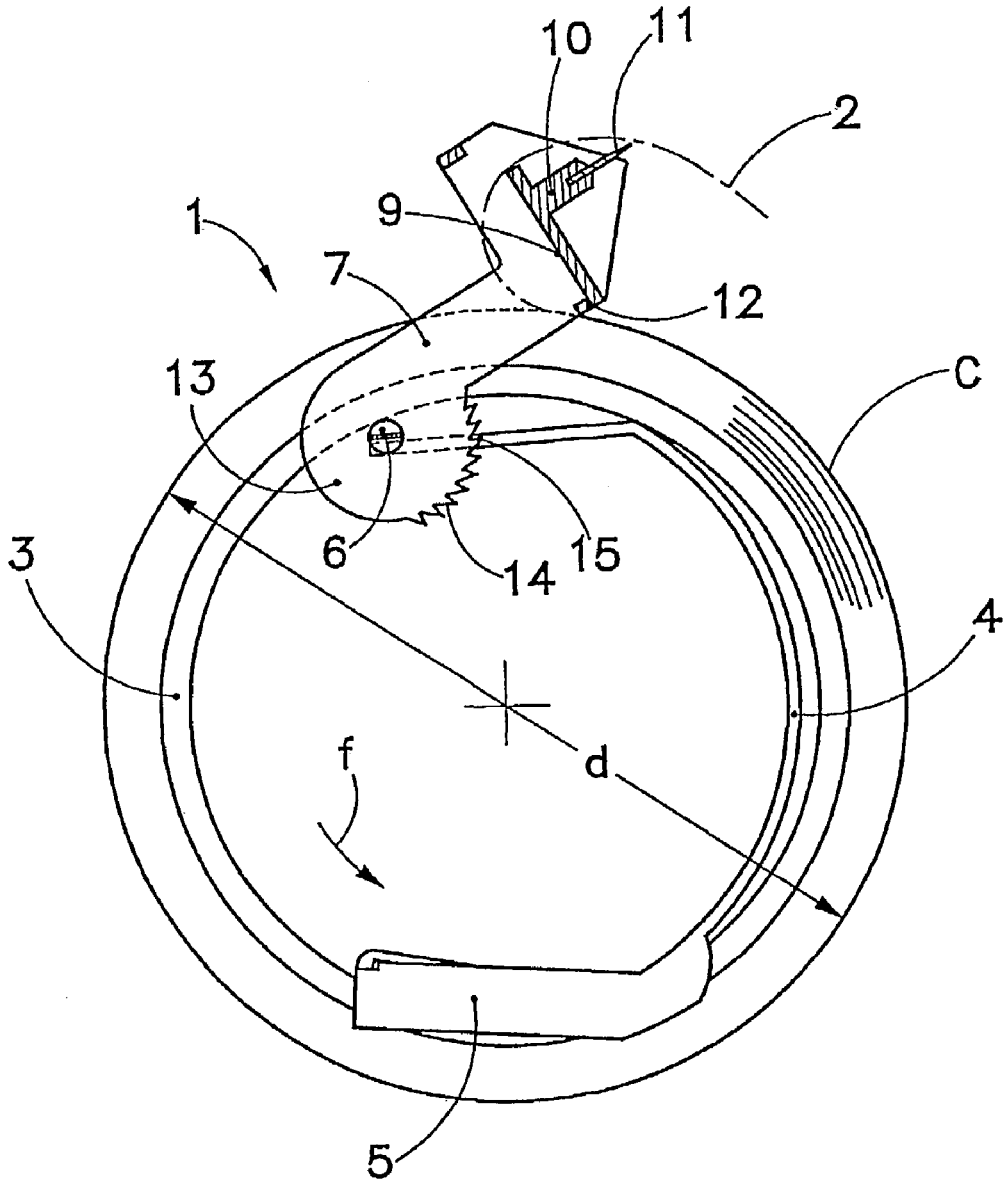
FIG. 3 shows an elevation of the tape roll of smaller diameter (d) with a drawing-off and cutting device, which is shown partially in section.

In FIG. 3, the roll of tape 2 is illustrated with a smaller diameter (d).

Figure 4:
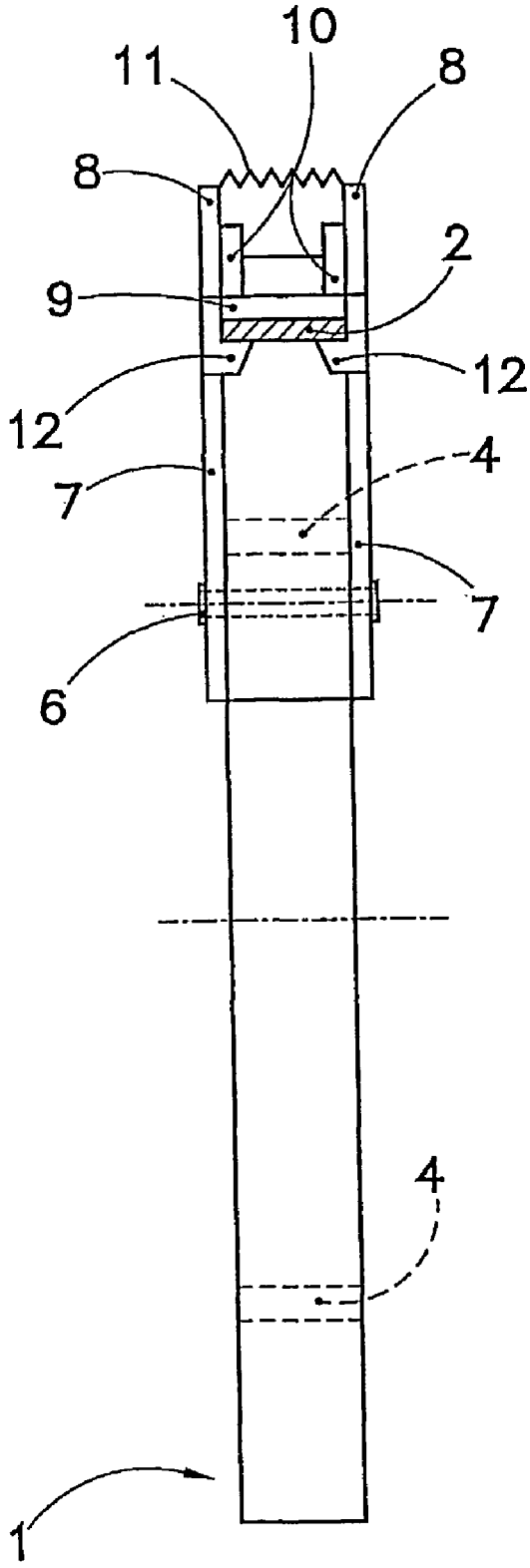
FIG. 4 shows the tape roll together with the drawing-off and cutting device in front view.

FIG. 4 reveals the device 1 in front view according to arrow IV of FIG. 1.

In order to draw the tape 2 off the roll 1, the total entity comprising elastic bracket 4, tubular core 3 and tape 2 is held in the hand of the user. As a result of the tape being drawn off, the tubular part 3 carries out a rotation with respect to the bracket 4.

By virtue of the provision of the ribs 5 projecting laterally from the bracket 4, the tubular core 3 has the possibility of carrying out a guided and unhampered rotational movement.

The provision of toothing 14 and 15 achieves the advantage that the rear edge 12 of the rib 9 is always aligned transversely with respect to the back of the roll, and as a result it is ensured that the cutter 11 is always arranged at a constant distance with respect to the circumference 10 of the roll of tape 1.

By virtue of the provision of toothing 14, which is provided along the circumference of each disk 13, the advantage is achieved that the roll formed by the tape 1 can be unrolled freely in the counterclockwise direction, that is to say in the direction in which the tape 2 is drawn off. Movement of the roll 1 in the clockwise direction is avoided by the teeth 14 and 15.

While the operation of cutting off a tape section 2' is being carried out, at any desired diameter (D, d) of the roll 1, it is ensured that the edges 12 arranged rearward rest on the circumference C of the tape roll with a blocking action, which means that a more precise, faster and more secure severing operation of the piece of tape 2' is made possible.

What is claimed is:

1. A device for drawing off and cutting tape from a tape supply roll wound on a tubular core, the device comprising an arcuate elastically deformable bearing and guiding bracket being rotatably accommodated inside the tubular core;

the bearing and guiding bracket having a first end and a second end;

the first end of the bearing and guiding bracket accommodates a rotatable pin extending across the tubular core;

a pair of parallel arms extend over the tape supply roll;

the parallel arms having each a first end and a second end, the first end of each arm being disk-shaped with a toothed circumferential area along an outside edge and being pivotally mounted to the rotatable pin, the second end of each arm is connected by a transverse rib which supports a cutting blade, between the transverse rib and the tape supply roll a space is formed allowing an end of the tape to be guided through; the bearing and guiding bracket having a holding tooth located on each side of the bearing and guiding bracket at the first end, the toothed circumferential area being engaged with the holding tooth of the bearing and guide bracket; the the second end of each arm is wing-shaped such that the end piece of the threaded tape is guided away from the tape supply roll.

2. The device, for drawing off and cutting a tape from a tape supply roll, according to claim 1, wherein the second end of the bearing and guiding bracket terminates in ribs which are dimensioned to engage around the sides of the tape supply roll.

3. The device for drawing off and cutting a tape from a tape supply roll according to claim 1, wherein the toothed circumferential area and the holding tooth are designed such that the tape supply roll is freely rotatable in the counterclockwise direction and blocked in clockwise direction.

4. A device for drawing off and cutting tape from a tape supply roll wound on a tubular core, the device comprising an arcuate elastically deformable bearing and guiding bracket being rotatably accommodated inside the tubular core;

the bearing and guiding bracket having a first end and a second end;

the first end of the bearing and guiding bracket accommodates a rotatable pin extending across the tubular core;

a pair of parallel arms extends over the tape supply roll;

the parallel arms having each a first end and a second end, the first end of each arm being disk-shaped with a toothed circumferential area along an outside edge and being pivotally mounted to the rotatable pin, the second end of each arm is connected by a transverse rib which supports a cutting blade positioned at a substantially right angle to the transverse rib, and between the transverse rib and the tape supply roll a space is formed allowing an end of the tape to be guided through; the bearing and guiding bracket having a holding tooth located on each side of the bearing and guiding bracket at the first end, the toothed circumferential area being engaged with the holding tooth of the bearing and guide bracket; the second end of each arm is wing-shaped such that the end piece of the threaded tape is guided away from the tape supply roll.

5. A device for drawing off and cutting tape from a tape supply roll wound on a tubular core, the device comprising an arcuate elastically deformable bearing and guiding bracket being rotatably accommodated inside the tubular core;

the bearing and guiding bracket having a first end and a second end;

the first end of the bearing and guiding bracket accommodates a rotatable pin extending across the tubular core;

a pair of parallel arms extend over the tape supply roll;

the parallel arms having each a first end and a second end, the first end includes a toothed circumferential area disposed along an outside edge and the first end being pivotally mounted to a rotatable pin, the second end of each arm is connected by a transverse rib which supports a cutting blade positioned at a substantially right angle to the transverse rib, and between the transverse rib and the tape supply roll a space is formed allowing an end of the tape to be guided through;

the second end of each arm is wing-shaped such that the end piece of the threaded tape is guided away from the tape supply roll; the bearing and guiding bracket having a holding tooth located on each side of the bearing and guiding bracket at the first end, the toothed circumferential area being engaged with the holding tooth of the bearing and guide bracket.

6. The device for drawing off and cutting a tape from a tape supply roll according to claim 5, wherein the cutting blade is turned away form the tape supply roll.

* * * * *